United States Patent [19]

Montalvo

[11] Patent Number: 5,067,244

[45] Date of Patent: Nov. 26, 1991

[54] GUN SIGHT FOR SHOOTING MOVING TARGET

[76] Inventor: Fredrick N. Montalvo, #7, Box 7390, Nacogdoches, Tex. 75961

[21] Appl. No.: 547,613

[22] Filed: Jul. 3, 1990

Related U.S. Application Data

[63] Continuation-in-part of Ser. No. 283,150, Dec. 9, 1988, Pat. No. 4,937,944.

[51] Int. Cl.[5] ..... F41G 1/00

[52] U.S. Cl. ..... 33/261

[58] Field of Search ..... 33/261, 227, 233, 234; 42/100

[56] References Cited

U.S. PATENT DOCUMENTS

| | | | |
|---|---|---|---|
| 752,962 | 2/1904 | Eby | 33/261 |
| 891,063 | 6/1908 | Harris | 33/261 |
| 968,115 | 8/1910 | Bishop | 33/233 |
| 1,421,553 | 7/1922 | Pohl | 33/261 |
| 1,501,211 | 7/1924 | Forin | 33/233 |
| 2,056,469 | 10/1936 | King | 33/261 |
| 2,458,638 | 1/1949 | Pretzer | 33/261 |
| 4,937,944 | 7/1990 | Montalvo | 33/261 |

FOREIGN PATENT DOCUMENTS

| | | | |
|---|---|---|---|
| 159075 | 2/1921 | United Kingdom | 33/261 |

*Primary Examiner*—Harry N. Haroian
*Attorney, Agent, or Firm*—David L. Ray

[57] ABSTRACT

A gun sight attached to the rear end of the gun barrel near the eye of the shooter including a semi-circular ring through which the shooter can observe a flying target. Two horizontal arms are attached to the sight for alignment parallel to the earth and with a target traveling through the air.

12 Claims, 2 Drawing Sheets

GUN SIGHT FOR SHOOTING MOVING TARGET

CROSS-REFERENCE TO RELATED APPLICATIONS

This application is a continuation-in-part of U.S. patent application Ser. No. 07/283,150 filed 12/09/88 now U.S. Pat. No. 4,937,944.

BACKGROUND OF THE INVENTION

1. Field of the Invention

The invention relates to sights for guns, and, in particular, to sights for shotguns or rifles. More particularly, the present invention relates to a shotgun or rifle sight for shooting moving targets such as flying fowl, clay pigeons, or running animals such as deer.

2. Description of the Related Art

Hitting moving targets with a rifle or shotgun is very difficult for the inexperienced shooter. Shooting flying targets with a shotgun commonly requires practice over a long period of time. Practice is time consuming and expensive since many shotgun shells must be fired.

A novice learning to shoot a shotgun at flying targets could learn much faster with an expert coach. However, such expert shooting coaches are usually very expensive, and many sportsmen try to teach themselves to shoot moving targets through trial and error. Frequently such sportsmen develop bad habits such as not placing the gun stock firmly against the shoulder and not aligning the vertical axis of the gun stock in a plane perpendicular to the ground.

One of the biggest mistakes novice shooters make is the failure to lead the moving target. It is necessary, as is well known in the art, for a person firing a gun to point the gun ahead of the moving target so that the shot will arrive at the point at which the gun is aimed at the same time the moving target arrives at the point at which the gun is aimed.

Gun sights are well known in the art. Some gun sights are designed to assist a person shooting moving targets such as skeet, trap, flying fowl, and running animals.

One of the devices utilized in aiding shooters to hit flying targets is referred to as JW's Radar and is manufactured by JW's Radar, P.0. Box 228, Pennington, Ala. 36916 and was advertised in the November/December, 1988 issue of the periodical Southern Outdoors on page 38. The shotgun sight attaches to the end of the shotgun barrel from which the shot exits and includes a generally rectangular wire loop which extends upon the barrel and to the right side and the left side of the barrel of the shotgun.

U.S. Pat. No. 4,223,446 discloses a lead sight apparatus for shotguns including a paid of rings of a predetermined diameter spaced apart a predetermined distance from the barrel of a shotgun and extending outwardly from the shotgun barrel to the left and right side of the barrel.

U.S. Pat. No. 4,220,983 discloses an illuminated bow sight which includes a light emitting diode centrally located in a sighting ring and a battery to illuminate the diode. A switching device is provided on the bow sight to selectively connect and disconnect the battery to the light-emitting diode. The switching mechanism is arranged so that no additional wiring is required other than the two leads which are normally provided on a commercially available light-emitting diode.

U.S. Pat. No. 3,120,222 discloses an archery bow having a sighting device including a sighting window upon the handle portion, an elongated recess in the sighting window to receive a portion of a removable sighting member, a supporting mechanism for the sighting member including a pair of angle members, the long flange of each member secured to the opposite sidewalls of the recess, the short flange of each angle member arranged flush with and extending from the related upper edge of the recess toward the center thereof to provide supporting surfaces for the sighting member, and a flexible cover removably snap-fitted to the supporting mechanism to cover the space and seal the recess from ingress of foreign matter when the sighting member is detached from the bow.

U.S. Pat. No. 2,941,296 discloses an archery sight including, in combination with an archery bow, a bow sight apparatus including a track mounted on a portion of the bow, a carrier, the carrier including a partially split cylinder having a pair of legs separated by a cut beginning on a chord at one end and extending along a plane substantially parallel to the axis of the cylinder to a point spaced from the other end, at least one track-receiving-guideway extending through the cylinder in a direction substantially transverse to the axis of the cylinder, the track-receiving guideway communicating with the cut in the cylinder, the track penetrating the track-receiving-guideway extending through the opposed ends of the carrier and communicating with the cut and the track-receiving-guideway partially obstructing the rod-receiving-guideway, an instrument having a rod rigidly secured thereto, the rod forced through the rod-receiving-guideway and past the obstructing track portion whereby the legs of the cylinder are spread apart thereby forcing the rod into frictional engagement between the track.

U.S. Pat. No. 2,932,896 discloses a front sight for a gun including a ring adapted to embracingly receive the barrel of a firearm, a ramp exteriorly of the ring and carried by the ring, an open-ended hood superimposed upon and carried by the ramp, an open-ended sleeve and a hairline member extending from the bead to the inner perimeter of the sleeve, the sleeve being insertable into and withdrawable from one end of the hood and being rotatable when fully inserted in the hood from a position in which the hairline member lies either along the horizontal or vertical plane, and a releasable latch element carried by the ramp and engageable with a mechanism on one end of the sleeve when wholly inserted and rotated in the desired position in the hood for holding the sleeve in the position in the hood.

U.S. Pat. No. 2,498,155 discloses a gun sight made from a single, elongated piece of material having a flat base portion at one end adapted to be attached to a gun barrel, the material at one end of the base portion being folded to provide a sight portion extending at right angles to the base portion, the fold extending at a angle 45° to the longitudinal edges of the base portion and extreme end of the sight portion extending at an angle of 45° to its edges, the sight portion being bent into circular form with angular end joining the corresponding angular fold.

U.S. Pat. No. 2,433,909 discloses a gun sight for the rear of a shotgun including an elongated tunnel member detachably mounted on the rear portion of a shotgun barrel in vertically spaced relation to the barrel and extending longitudinally thereof, a peep sight element provided within the tunnel member and vertical longitudinal plane of the barrel, and an additional sight provided at the forward edge portion of the tunnel member, the additional sight being laterally spaced from the vertical longitudinal plane.

U.S. Pat. No. 453,828 discloses a gun sight including a ring or peep sight connected to the gun having therein a central bead having a white or light end surrounded by the ring.

SUMMARY OF THE INVENTION

In accordance with the present invention there is provided a gun sight attached to the rear end of the gun barrel near the eye of the shooter including a semi-circular ring through which the shooter can observe a flying target. Two horizontal arms nay be attached adjacent to the sight or located at the front end of the gun barrel for alignment parallel to the earth and with a target traveling through the air.

BRIEF DESCRIPTION OF THE PREFERRED EMBODIMENTS

Figure 1:
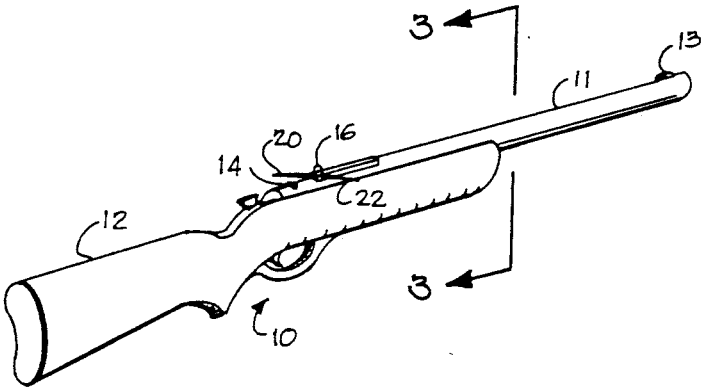
FIG. 1 is a perspective view of a gun having the sight of the present invention mounted thereon.

Referring now to the drawings, in FIG. 1 is shown a gun which may be a rifle or a shotgun generally indicated by the numeral 10 which has a barrel 11 and stock 12. The gun may have a conventional front sight indicated by the number 13 and a rear sight 14 which is generally found on a rifle but not commonly found on a shotgun. Some shotguns do contain rear sights when the shotgun is marketed for shooting slugs and buckshot at various game such as deer and bear.

Figure 3:
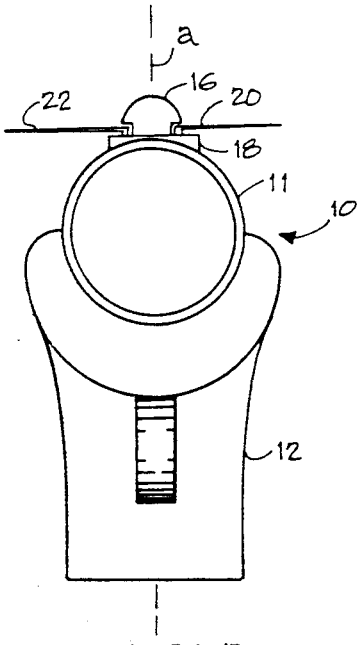
FIG. 3 is a cross sectional view taken along lines 3—3 of FIG. 1.
Figure 4:
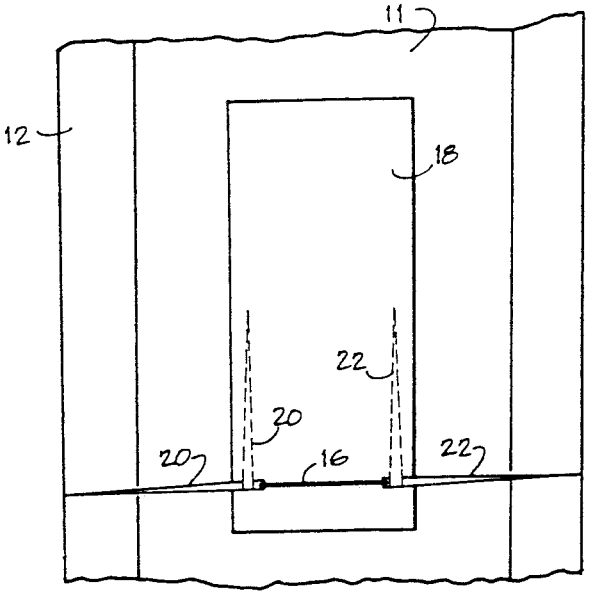
FIG. 4 is a top view, partially cut away, of the gun sight of FIG. 1.

In FIGS. 1, 3, and 4 is shown a preferred embodiment of the gun sight of the present invention. The gun sight includes a thin sight ring indicated by the numeral 16 which is located at the rear of the shotgun, preferably about 10 to 12 inches from the eye of the person shooting the gun. The ring 16 is generally semicircular in shape and is preferably about one quarter inch in diameter and about one quarter inch high.

The sight ring 16 is attached to a base 18 which in turn is attached to the gun barrel 11. Base 18 may be attached by any suitable means such welding, gluing, clamping, snapping or the like, and may be of any desired construction. Ring 16 is attached to base 18 by any conventional means such as screwing, welding, clamping, force fitting or the like. Ring 16 may be made from any desired material such as metal, plastic, wire or the like. Preferably, a sight ring 16 is made from a wire or plastic filament having an outside diameter of about 1/16 inch.

Preferably, attached to base 18 are arms 20 and 22. Arms 20 and 22 are connected preferably adjacent to ring 16 and extend outwardly approximately ½ inch from each side of ring 16. Arms 20 and 22 are aligned parallel to the ground and perpendicular to the vertical axis "a" which extends through the stock 12 of gun 10. Arms 20 and 22 may fold forwardly as shown in FIG. 4 or backwardly if desired when the gun 10 is not in use.

Arms 20 and 22 provide a reference which teaches the shooter to keep the gun and arms 20 and 22 aligned horizontally with the ground and in proper alignment with the shoulder of the shooter. Furthermore, arms 20 and 22 provide a reference for tracking a bird flying generally horizontally to the ground which is a common path for water fowl and other fowl to travel in reference to the shooter. Thus, the hunter can track the moving target horizontally with arms 20 and 22 until the moving target is aligned within ring 16. Thus, the hunter will have his gun properly aligned with target and achieve a clean hit. If desired, the hunter could use the ring 16 alone or the arms 20 and 22 only. However, it is preferred that the combination of ring 16 and arms 20 and 22 be used for best results.

Figure 2:
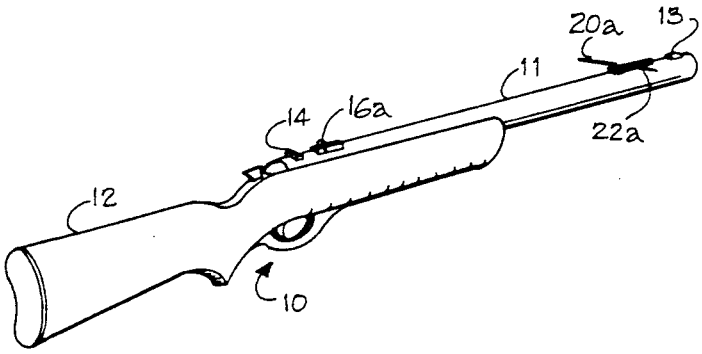
FIG. 2 is a perspective view of a gun having one portion of the sighting mechanism mounted at the rear of the gun and the arms mounted at the front end of the gun.

In FIG. 2 is shown an alternate embodiment of the invention wherein ring **16*a* is identical to ring 16 previously disclosed, arm 20*a* is identical to arm 20 previously disclosed, and arm 22*a* is identical to arm 22 as previously described. The difference is that arm 20 and arm 22*a* are mounted on the forward end of the barrel near sight 13. Arms 20 and 20*a*** are also found to aid the shooter in this position.

Improper mounting of the shotgun to the shoulder and cheek is the most common error made by shooters. Professionals agree that the average shooter will not place the gun butt in the same place two shots in succession. Misses are almost never made in front of the target; they are almost always made behind. Placement of the gun butt on the pectoral muscle between the shoulder arm socket and the neck is the desired position. The placement of the gun butt away from the neck and closer to the shoulder arm socket will cause, almost every time, a non-alignment between the line of sight and where the gun is pointing. In almost every case, the shot will be to the left of the target. This placement would also eliminate a very important technique and procedure of placing the cheek firmly on the comb of the gun stock throughout the shot. Placement of the gun butt too high on the shoulder will cause the shot to go below the target. Placement of the gun butt too low on the shoulder will cause the shot to go above the target. Improper mounting can compound the error because the shot can be below or above but also to the left.

The gun sight shown in FIGS. 1 through 4, including a semi-circular ring, is attached to the rear end of the gun barrel near the eye of the shooter of at a point whereby the shooter in most comfortable and through which the shooter can observe a proper or improper mounting of the shotgun or rifle to the shoulder and cheek. By sighting through the semi-circular ring, the shooter can instantly observe if the bead on the shotgun at the end of the barrel is centered inside of the semi-circular ring. That being the case, the shooter's line of sight and vision any where the shotgun is pointed is one and same. If the bead is outside of the semi-circular ring, the shooter can make the proper alignment. Furthermore, by sighting through the semi-circular ring, the shooter can observe flying and running targets.

Figure 5:
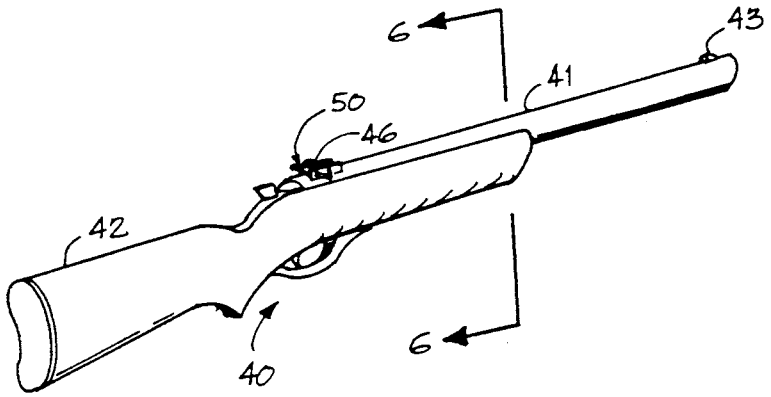
FIG. 5 is a perspective view of a gun having an alternate embodiment of the sight of the invention mounted thereon.
Figure 6:
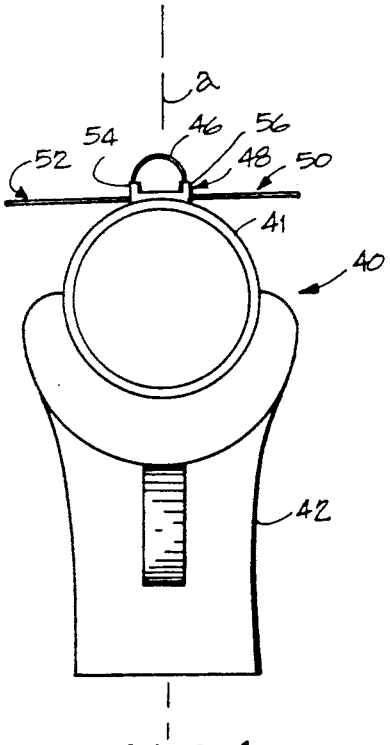
FIG. 6 is a cross sectional view taken along lines 6—6 of FIG. 5.
Figure 7:
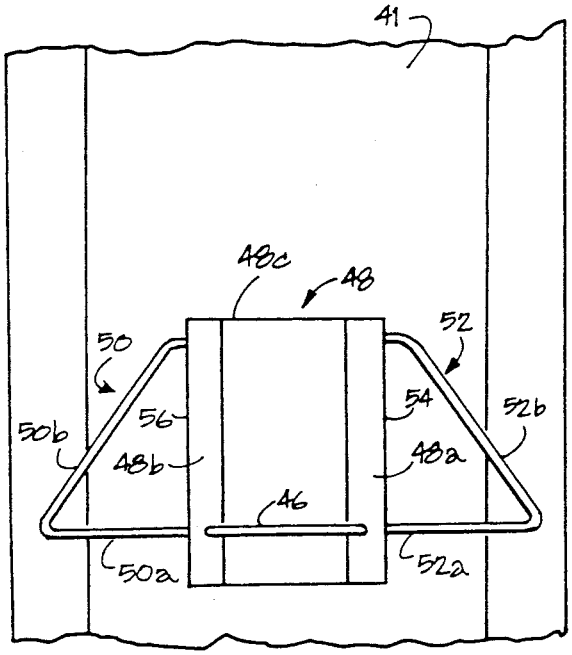
FIG. 7 is a top view, partially cut away, of the gun sight of FIG. 5.

The preferred alternate embodiment is shown in FIGS. 5, 6 and 7. In FIG. 5 is shown a gun which may be a rifle or a shotgun generally indicated by the numeral 40 which has a barrel 41 and stock 42. The gun may have a conventional front sight indicated by the number 43 and a rear sight(not shown) which is generally found on a rifle but not commonly found on a shotgun. Some shotguns do contain rear sights when the shotgun is marketed for shooting slugs and buckshot at various game such as deer and bear.

In FIGS. 6 and 7 the preferred alternate embodiment of the gun sight of the present invention can be seen to include a thin sight ring indicated by the numeral 46 which is located at the rear of the shotgun, preferably about 10 to 12 inches from the eye of the person shooting the gun. The ring 46 is generally semi-circular in shape and is preferably about one quarter inch in diameter and about one quarter inch high.

The sight ring 46 is attached to a base generally indicated by the numeral 48 which in turn is attached to the gun barrel 41. Base 48 may be attached by any suitable means such welding, gluing, clamping, snapping or the like, and may be of any desired construction. Ring 46 is attached to base 48 by any conventional means such as screwing, welding, clamping, force fitting or the like. Ring 46 may be made from any desired material such as metal, plastic, wire or the like. Preferably, a sight ring 46 is made from a wire or plastic filament having an outside diameter of about 1/16 inch.

Base 48 preferably has two upwardly extending shoulders 48*a* and 48*b* to which ring 46 is attached. Shoulders 48*a* and 48*b* have vertical sides 54 and 56 respectively. Vertical sides 54 and 56 are parallel to the vertical axis "a" shown in FIG. 6. Shoulders 48*a* and 48*b* are connected by horizontal plate 48*c* to form a "U" shaped sighting channel which aids the hunter in correctly aiming the gun. Preferably, shoulders 48*a* and 48*b* are integrally molded with horizontal plate 48*c*.

Preferably, attached to the vertical sides 54 and 56 of base 48 are the arms generally indicated by the numerals 52 and 50, respectively. Arms 50 and 52 have perpendicular portions 50*a* and 52*a* which are connected to sides 56 and 54 respectively, preferably adjacent to ring 46, and extend outwardly perpendicularly from base 48 approximately ½ inch from each side of ring 46. Arms 50 and 52 also have tapered portions 50*b* and 52*b* which extend from the ends of perpendicular portions 50*a* and 52*a* to base 48 to provide strength and rigidity to arms 50 and 52.

Arms 50 and 52 are aligned parallel to the ground and perpendicular to the vertical axis "a" which extends through the stock 42 of gun 40. Arms 50 and 52 provide a reference which teaches the shooter to keep the gun and arms 50 and 52 aligned horizontally with the ground and in proper alignment with the shoulder of the shooter. Furthermore, arms 50 and 52 provide a reference for tracking a bird flying generally horizontally to the ground which is a common path for water fowl and other fowl to travel in reference to the shooter. Thus, the hunter can track the moving target horizontally with arms 50 and 52 until the moving target is aligned within ring 46. Thus, the hunter will have his gun properly aligned with target and achieve a clean hit. It is preferred that the combination of ring 46 and arms 50 and 52 be used for best results.

Improper mounting of the shotgun to the shoulder and cheek is the most common error made by shooters. Professionals agree that the average shooter will not place the gun butt in the same place two shots in succession. Misses are almost never made in front of the target; they are almost always made behind. Placement of the gun butt on the pectoral muscle between the shoulder arm socket and the neck is the desired position. The placement of the gun butt away from the neck and closer to the shoulder arm socket will cause, almost every time, a non-alignment between the line of sight and where the gun is pointing. In almost every case, the shot will be to the left of the target. This placement would also eliminate a very important technique and procedure of placing the cheek firmly on the comb of the gun stock throughout the shot. Placement of the gun butt too high on the shoulder will cause the shot to go below the target. Placement of the gun butt too low on the shoulder will cause the shot to go above the target. Improper mounting can compound the error because the shot can be below or above but also to the left.

The one piece gun sight shown in FIGS. 5–7, including semi-circular ring 46 and arms 50 and 52, is attached to the rear end of the gun barrel near the eye of the shooter of at a point whereby the shooter in most comfortable and through which the shooter can observe a proper or improper mounting of the shotgun or rifle to the shoulder and cheek. By sighting through the semi-circular ring 46, the shooter can instantly observe if the bead on the shotgun at the end of the barrel is centered inside of the semi-circular ring. That being the case, the shooter's line of sight and vision any where the shotgun is pointed is one and same. If the bead is outside of the semi-circular ring, the shooter can make the proper alignment. Furthermore, by sighting through the semi-circular ring, the shooter can observe flying and running targets.

Although the preferred embodiments of the invention have been described in detail above, it should be understood that the invention is in no sense limited thereby, and its scope is to be determined by that of the following claims:

What is claimed is:

1. A gun sight for assisting a shooter in hitting a moving target with a gun having a barrel connected to a stock comprising:

a. sight ring assembly connected to the top of a gun barrel near the rear end of the gun barrel for alignment of the gun with a moving target, said sight ring assembly having i. a base means, said base means having a top side, a bottom side, and two vertical sides, said bottom side being connected to the top of said gun barrel, ii. a semi-circular sight ring connected to said top side of said base means, said sight ring being generally semi-circular in shape, said sight ring extending vertically upward from the top of said gun barrel, the plane in which said sight ring lies being perpendicular to the centerline of said gun barrel, and iii. two horizontal arm means connected to said vertical sides of said base means, said arm means extending outwardly from said gun barrel generally perpendicular to the vertical axis of the stock attached to the gun barrel.

2. The gun sight of claim 1 wherein said base means has two shoulder means connected to the top side thereof, said vertical sides forming the outer walls of said shoulder means, said shoulder means forming channel means therein.

3. The gun sight of claim 2 wherein said sight ring is connected to the top of said shoulder means.

4. The gun sight of claim 1 wherein said arm means are connected to said vertical sides of said base means between said top side of said base means and said bottom side of said base means.

5. The gun sight of claim 1 wherein said arm means comprise perpendicular portions and tapered portions.

6. The gun sight of claim 5 wherein said perpendicular portions are connected perpendicularly to said vertical sides, and said tapered portions extend from the outer most ends of said perpendicular portions to said vertical sides.

7. The gun sight of claim 1 wherein said sight ring is located about 10 inches from the eye of the shooter.

8. The gun sight of claim 1 wherein said sight ring is about ¼ inch in diameter.

9. The gun sight of claim 1 wherein said sight ring is about ¼ inch high.

10. The gun sight of claim 1 wherein said gun is a shotgun.

11. The gun sight of claim 1 wherein said gun is a rifle.

12. The gun sight of claim 1 wherein said sight ring is formed from a material having an outside diameter of about 1/16 inch thick.

* * * * *